US005400446A

United States Patent [19]

Bloemer et al.

[11] Patent Number: 5,400,446

[45] Date of Patent: Mar. 28, 1995

[54] SEAT COVER ACTUATED FLUSHING MECHANISM FOR TOILET

[75] Inventors: John M. Bloemer; Anton J. Kolar, both of Sheboygan; Jeffrey C. Hildebrand, Kohler; Michael J. Kurth, West Bend, all of Wis.

[73] Assignee: Kohler Co., Kohler, Wis.

[21] Appl. No.: 126,746

[22] Filed: Sep. 27, 1993

Related U.S. Application Data

[63] Continuation of Ser. No. 824,808, Jan. 22, 1992, abandoned.

[51] Int. Cl.[6] ..... E03D 5/04

[52] U.S. Cl. ..... 4/408; 4/250

[58] Field of Search ..... 4/249, 250, 313, 405, 4/406, 408, 412, 413, 414

[56] References Cited

U.S. PATENT DOCUMENTS

| | | | |
|---|---|---|---|
| 939,123 | 11/1909 | Christy | 4/394 |
| 945,424 | 1/1910 | Tilden | 4/414 |
| 1,456,196 | 5/1923 | Staats | 4/406 |
| 1,743,340 | 1/1930 | Grant | 4/413 X |
| 1,930,012 | 10/1933 | Lundberg | 4/330 |
| 2,056,087 | 9/1936 | Andrews | 4/406 |
| 2,164,503 | 7/1939 | Desroche | 4/250 |
| 2,428,685 | 10/1947 | Shepard | 4/250 |
| 2,529,633 | 11/1950 | Russell | 4/250 |
| 2,635,691 | 4/1953 | Filliung | 4/313 X |
| 2,813,274 | 11/1957 | Lewis et al. | 4/313 |
| 3,121,880 | 2/1964 | Gelhar | 4/249 |
| 3,406,408 | 10/1968 | Hudson | 4/405 |
| 3,462,768 | 8/1969 | Lefebvre et al. | 4/412 X |
| 3,518,703 | 7/1970 | Haldopoulos et al. | 4/412 |
| 3,590,397 | 7/1971 | Akamatsu | 4/313 |
| 3,992,728 | 11/1976 | Jay | 4/405 X |
| 4,195,374 | 4/1980 | Morris et al. | 4/249 X |
| 4,392,260 | 7/1983 | Bensen | 4/324 |
| 4,573,223 | 3/1986 | Schmidt | 4/408 |
| 4,831,670 | 5/1989 | Velasquez | 4/408 |
| 5,003,643 | 4/1991 | Chung | 4/406 X |
| 5,054,132 | 10/1991 | Bartella | 4/313 X |

FOREIGN PATENT DOCUMENTS

| | | | |
|---|---|---|---|
| 0187425 | 8/1991 | Japan | 4/406 |

OTHER PUBLICATIONS

*The New York Times,* "A Device That's Likely To Please Everyone", Feb. 15, 1992.

*Primary Examiner*—William A. Cuchlinski, Jr.
*Assistant Examiner*—John L. Beres
*Attorney, Agent, or Firm*—Quarles & Brady

[57] ABSTRACT

A flushing mechanism for a toilet triggers a flush in response to the closing of the toilet seat cover. A magnet is attached to the seat cover and detected by a sensor. The sensor activates a battery powered motor having a crank arm which directly raises a flapper valve by means of a tensile link. The sensor and motor unit are suspended out of sight in the tank of the toilet by flanges fitting between the tank rim and the tank top. The flanges allow adjustment of the motor and sensor to a variety of preexisting tank type toilets for effective retrofitting. A delay timer prevents repeated energy wasting flushing of the toilet.

6 Claims, 3 Drawing Sheets

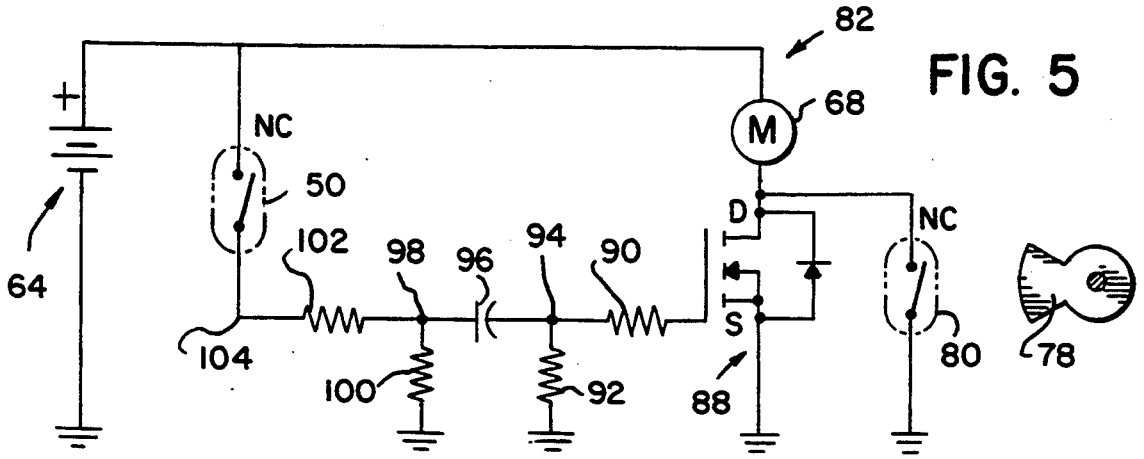
FIG. 5
FIG. 4a
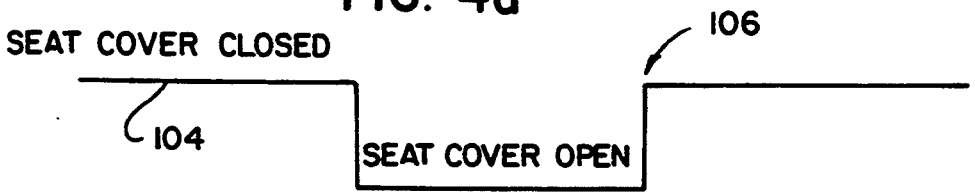
FIG. 4b
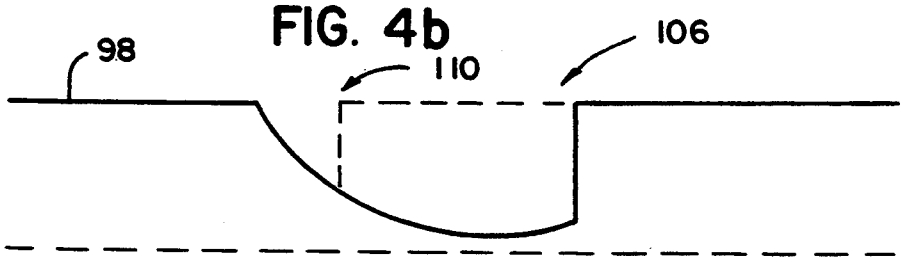
FIG. 4c
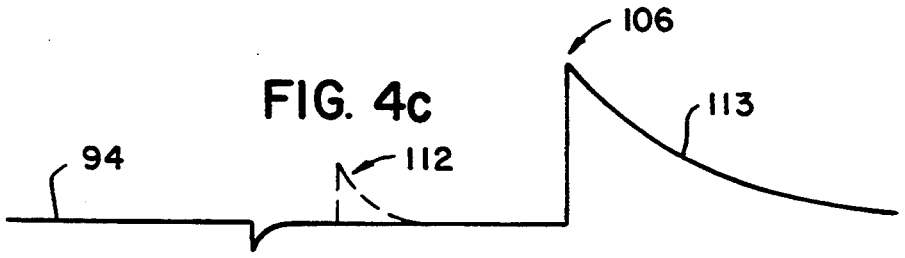
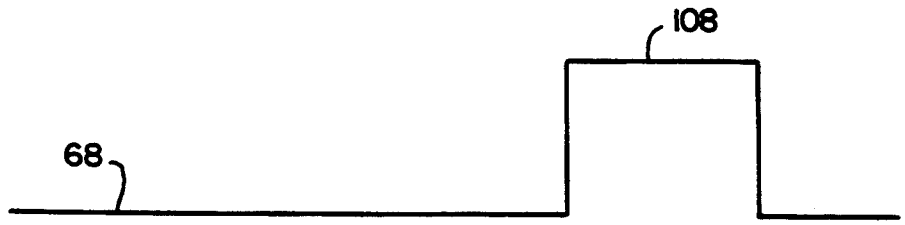
FIG. 4d

SEAT COVER ACTUATED FLUSHING MECHANISM FOR TOILET

This application is a continuation of application Ser. No. 07/824,808, filed Jan. 22, 1992, now abandoned.

FIELD OF THE INVENTION

This invention relates to flushing mechanisms for toilets. In particular, the design provides a flushing mechanism activated by closure of a toilet seat cover that is suitable for being retrofit into existing tank-type toilets.

BACKGROUND OF THE ART

Ensuring that the toilet seat is returned to the closed position after use of the toilet is a common problem. The widely used two-part toilet seat includes a seating ring and a cover, both hinged to the bowl. The seating ring, when in a closed position over the rim of the bowl, provides a comfortable seating surface for the user of the toilet. The cover, when in the closed position, covers the closed seating ring. Both the seating ring and the cover, or the cover alone, may swing upward from the closed position to an open position away from the rim of the bowl to rest against a stop, the stop often being on the front of the toilet tank.

It is usually desired that the seating ring and the cover be left in the closed position between uses of the toilet. The closed cover improves the aesthetic qualities of the toilet, limits access to the water in the bowl by, e.g., pets or small children, and prevents objects from inadvertently falling into the open bowl. Closing the cover after use of the toilet also ensures that the seating ring, which is positioned below the cover on the hinge, is in the closed position. This closing of the seating ring also prevents a subsequent unwary user from inadvertently sitting directly on the toilet rim or falling into the bowl.

Despite the advantages of closing the toilet seat after use of the toilet, remembering to close the seat is difficult, and reminders by others, typically are much after the fact. Direct censure of the forgetful users may, further, have the undesirable collateral effects of engendering embarrassment or hostility.

SUMMARY OF THE INVENTION

The present invention provides a mechanism for encouraging the user of a toilet to return the toilet's seat and cover to the closed position after use. In particular, the mechanism is suitable for retrofit into existing tank-type toilets.

Specifically, a magnet is positioned to move with the seat cover to lie adjacent to a magnet sensor in either the open or closed position. The sensor produces a signal indicating the position of the cover and activates a motor after a transition of the cover between the open and closed positions. The motor turns a crank arm attached to the motor shaft and there is a pivot orbiting the motor shaft. The pivot pulls a tensile link to open the flapper valve and allow flushing of the toilet.

It is one object of the invention, therefore, to encourage the closing of the toilet seat cover after use. The magnet and sensor serve in lieu of the conventional flush lever, thus requiring closing of the seat cover to flush the toilet Combining the functions of closing and flushing reduces the effort required to do both, further encouraging such closing.

It is also an object of the invention to provide such a flushing mechanism which may be practically retrofitted into a standard tank-type toilet. The use of the motor driven crank arm permits the apparatus to work with flapper valves typically found in toilets. The single pivot of the crank arm provides a simple and energy efficient activation of the flapper valve permitting the unit to be battery powered, if desired, thus avoiding the need for additional wiring. The motor unit may include a flange to allow it to hang over the lip of the tank and be held by the tank top. This eliminates the need to drill mounting holes or the like in the ceramic tank structure, yet permits sliding adjustment of the motor unit over the flapper valve to fit the particular toilet type.

The motor unit may also incorporate a delay timer for preventing the flushing of the toilet for a predetermined period after first opening of the toilet lid.

It is also another object of the invention to provide a battery powered flushing mechanism that resists rapid repeated flushings of a type that might wear down the battery and would be ineffective as a result of the failure of the tank to completely refill.

Other objects and advantages besides those discussed above will be apparent to those skilled in the art from the description of the preferred embodiment of the invention which follows. Thus, in the description, reference is made to the accompanying drawings, which form a part hereof, and which illustrate one example of the invention. Such example, however, is not exhaustive of the various alternative forms of the invention. Therefore, reference should be made to the claims which follow the description for determining the full scope of the invention.

BRIEF DESCRIPTION OF THE DRAWINGS

FIGS. 4(*a*)–(*d*) is a graph showing the signal from the magnet sensor and other related signals as the seat cover is moved between the open and closed positions;

FIG. 5 is a schematic of the circuit used to control the motor in response to signals of FIG. 4(*a*)–(*d*)

DESCRIPTION OF THE PREFERRED EMBODIMENT

Figure 1:
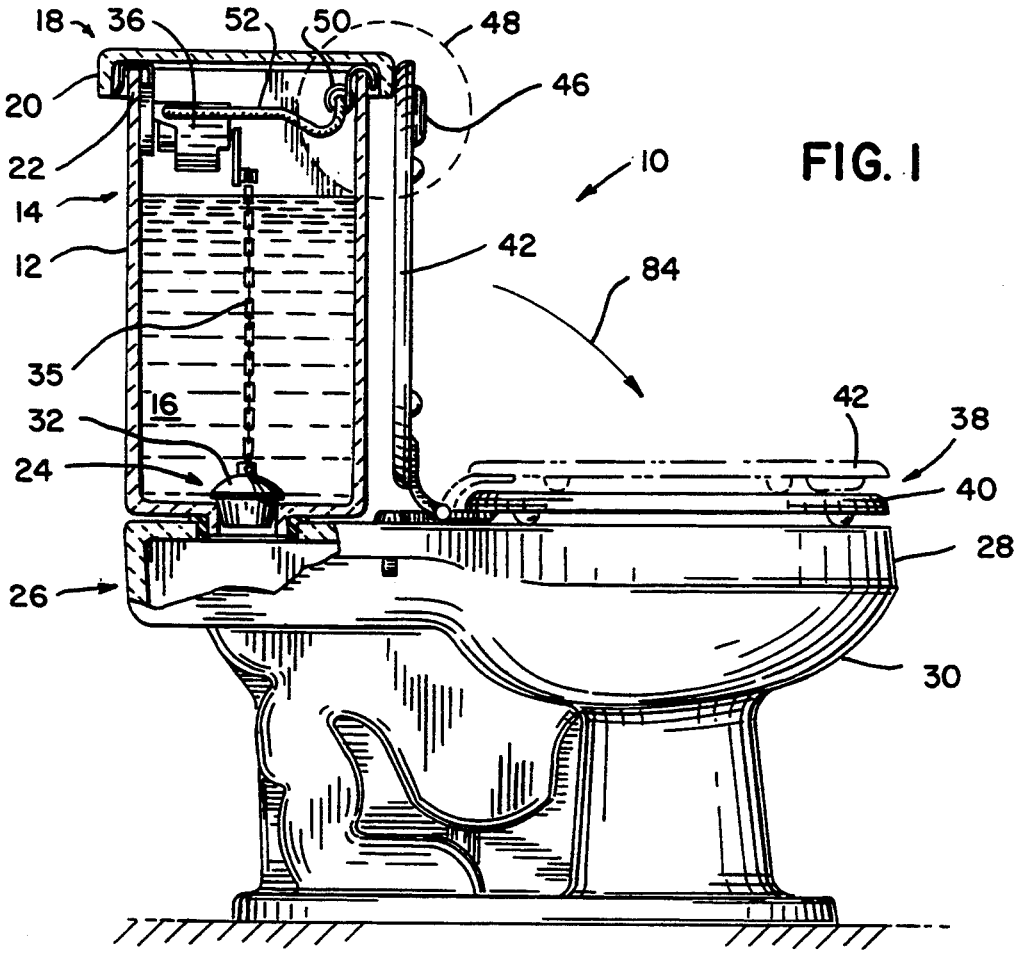
FIG. 1 is a view in elevation of a toilet with a partial cutaway of the tank.

Referring to FIG. 1, there is provided a tank-type toilet 10 suitable for use with the flush mechanism of the present invention. It includes an upstanding water reservoir 12 filled with water 16 to a water height. A conventional float activated inlet valve can be used to refill the tank. The upper portion 18 of the reservoir 12 includes an opening capped by a reservoir cover 20 which rests on a rim 22, the latter being simply the upper end 18 of the walls of the reservoir 12.

The reservoir 12 is positioned at the rear of the toilet 10 and has in its bottom wall an opening 24 communicating with a bowl structure 26 of the toilet 10 so as to pass water 16 from the reservoir 12 through channels internal to the bowl structure in the usual fashion. Bowl rim 28 includes a plurality of ports which communicate the water 16 into the bowl 30 to provide for a flushing of the toilet 10 as is well understood in the art.

Figures 3A, 3B, 3C:
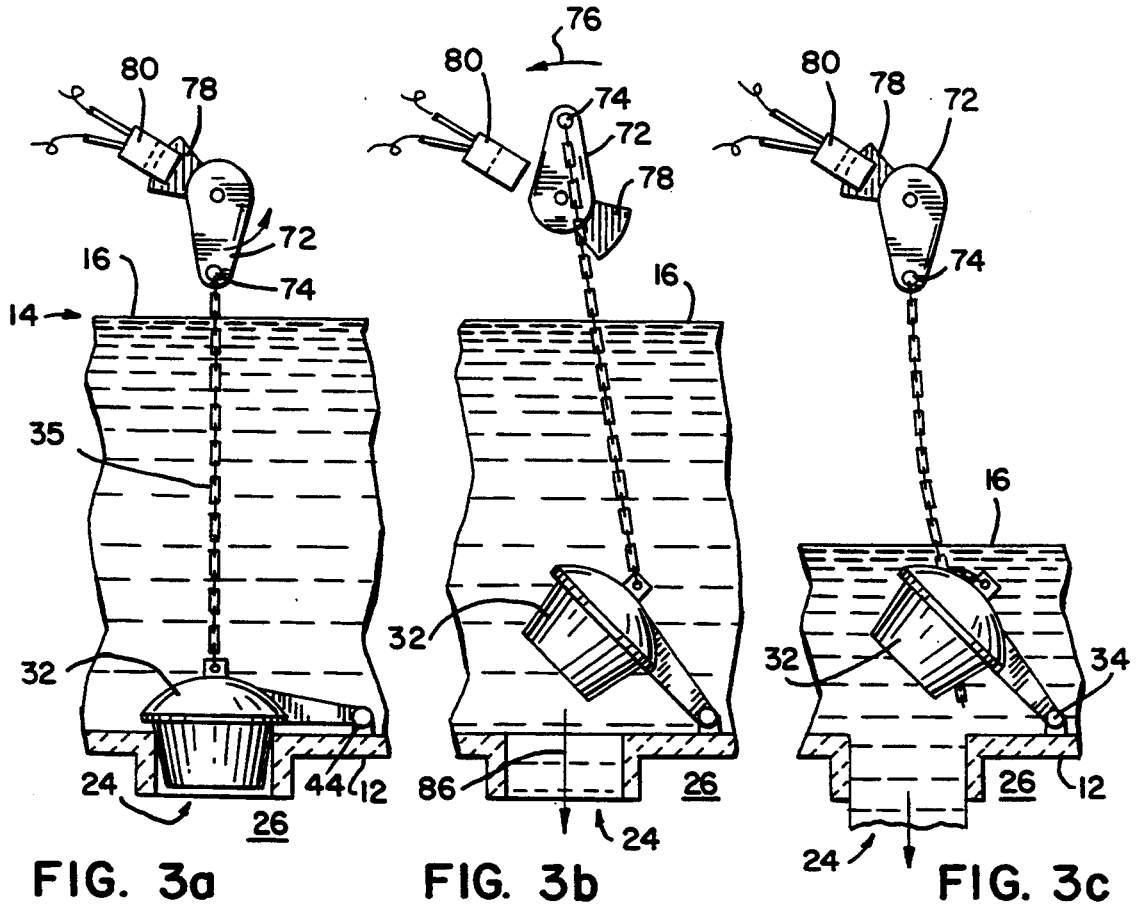
FIGS. 3(*a*)–(*c*) are schematic representations of the crank arm and flapper valve of FIGS. 1 and 2 in various stages of the flushing cycle.

The opening 24 between the reservoir 12 and the bowl structure 26 is normally closed by an elastomeric flapper valve 32 hinged about a pivot point 34 (shown in FIG. 3(*c*)) to move between a closed state, obstructing the opening 24 and preventing water flow therethrough, and an open state removed upward from the opening 24 to allow the flow of water through that opening. As will be described in detail below, typically the flapper valve 32 is somewhat buoyant in the water 16 but held in the closed position when the reservoir 12 is filled with water 16 by the differential force of that water applied solely to its upper surface when the flapper valve 32 rests within the opening 24.

A chain 35 attaches from the top of the flapper valve 32 to a flushing motor assembly 36, the latter which may pull the flapper valve 32 from the closed state to the open state as will be described in more detail below.

A toilet covering assembly 38 comprised of a seating ring 40 and a cover 42, is attached to the rear of the rim 28 by a conventional hinge 44 so as to swing between a generally vertical, open position, resting against the front wall of the rearward positioned reservoir 12, and to a generally horizontal, closed position lying adjacent to the rim 28. In the closed position, the cover 42 lies on top of the seating ring 40. Thus when the cover 42 is closed, the seating ring 40 must also be closed.

The seating ring 40 is generally annular in shape to conform to the annular rim 28 and to provide support for a seated user. The cover 42 is a planar structure following the outline of the seating ring 40 and rim 28 to cover the opening of the bowl 30.

A magnet 46 is preferably attached to the cover 42 so as to lie adjacent to the upper rim 22 of the reservoir 12 when the cover 42 is in the open position. In the alternative, the magnet could be on the seat, (e.g. if no top cover is provided) and the term cover should be broadly construed to include the seating ring in such situations. The magnet 46 is of sufficient strength, and lies close enough to the reservoir 12 when the cover 42 is in the open position, so that a threshold level magnetic field boundary 48 extends into the reservoir 12 in the area of the rim 22. Yet the magnet 42 is not so strong that when the cover 42 is in the closed position, the magnetic field boundary 48 will extend into the reservoir 12.

A magnet sensor 50 is preferably placed within the reservoir 12 and within the area of the magnetic field boundary 48 when the cover 42 is in the open position. It detects the magnetic field of the magnet 46 and then provides a signal when the cover 42 moves from the open to the closed position. A flexible lead 52 connects the magnet sensor 50 to the flushing motor assembly 36 to permit the magnet sensor 50 to be mounted near the front of the reservoir 12 independent of the mounting of the flushing motor assembly 36 near the rear of the reservoir 12.

Figure 2:
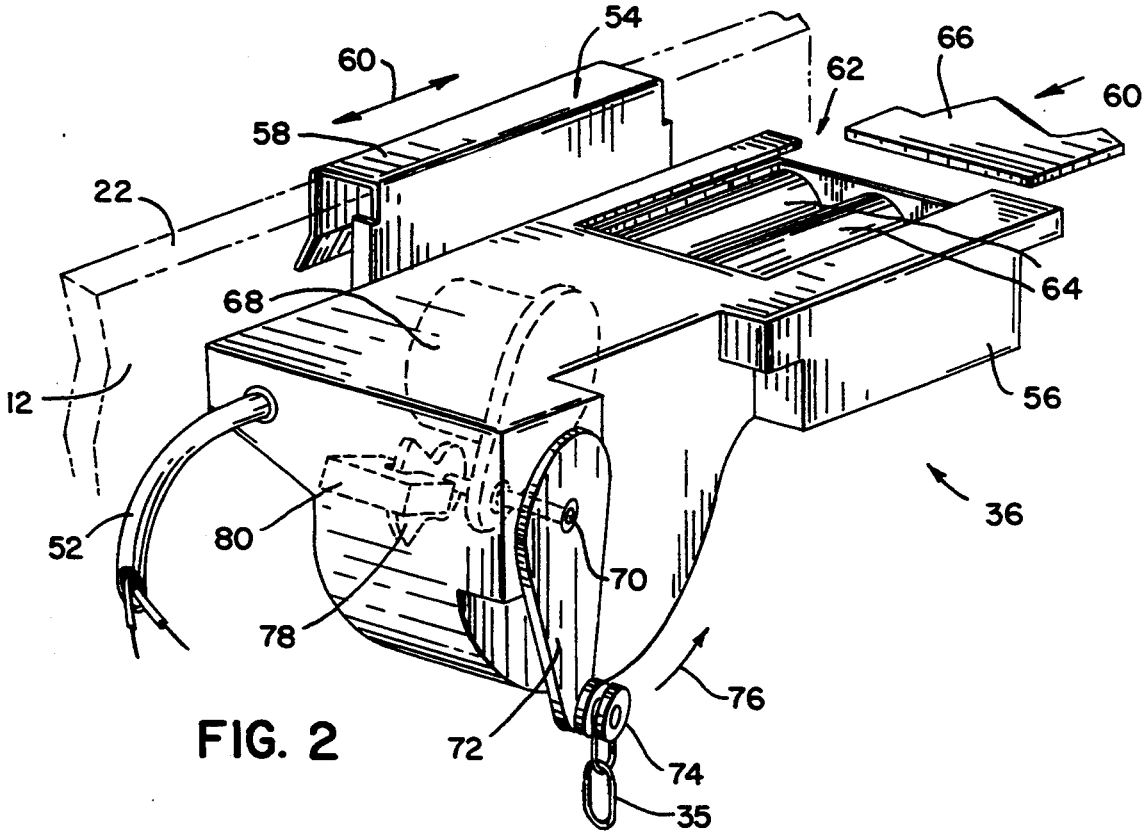
FIG. 2 is an enlarged perspective view of the motor unit of FIG. 1.

Referring now to FIGS. 1 and 2, a mounting bracket 54 hooks over the top of the rim 22 of the rear of the reservoir 12 to support a housing 56 of the flushing motor assembly 36 above the water height 14. The mounting bracket 54 includes a flange portion 58 which is captured between the rim 22 and the lower surface of the reservoir cover 20 to hold the mounting bracket 54 firmly in place. Prior to placement of the reservoir cover 20 on the flange portion 58, the mounting bracket 54 is free to slide in a lateral direction 60 to permit adjustment of the position of the flushing motor assembly 36 so the pivot 74 can be at a point substantially vertically aligned with the flapper valve 32 for a variety of reservoir designs. The mounting bracket 54 eliminates the need for modification of the reservoir 12, e.g. drilling holes, and makes the flushing mechanism of the present invention suitable to be retrofit to most ceramic reservoirs 12.

Housing 56 of the flushing motor assembly 36 includes a battery compartment 62 that holds two "D" cell batteries 64. It is covered by a sliding cover 66, the latter which may be removed in the lateral direction 60 to permit replacement of the batteries.

The housing 56 also includes a motor 68 having its shaft 70 extending through the housing 56 toward the center of the reservoir 12 to drive a crank arm 72. The end of the crank arm 72 that is removed from the shaft 70 holds a pivot 74 to which is attached the upper end of chain 35. The crank arm 72 is rotated by the motor 68 in a counterclockwise direction 76 to provide a simple and efficient lifting of the flapper valve 32 without the friction and additional mechanism required of lever type systems. Avoiding the traditional but bulky lever type system for direct activation by a crank arm 72 and the ability to easily reposition the flushing motor assembly 36 along the rim 22 over the flapper valve 36 provides increased flexibility in the flushing mechanism's ability to fit in different toilet types.

Attached to motor shaft 70 inside of housing 56 is vane 78 which rotates with the motor shaft 70 to periodically interrupt internal magnet sensor 80 and thus to provide an indication of the position of motor shaft 70 and crank arm 72. The position of vane 78 is such as to interrupt magnet sensor 80 when the pivot 74 is in its lowermost position.

Also included within the housing 56 of the flushing motor assembly 36 is motor control circuit 82 (see FIG. 5) which controls the motor 68 based on signals from the sensors 50 and 80.

Referring now to FIG. 1 and FIGS. 3(*a*) through 3(*c*), prior to the start of a flush, the water 16 is at water height 14 in the reservoir 12 and the flapper 32 closes the opening 24 preventing water from flowing into the bowl structure 26. When the toilet 10 is used, the cover 42 (or the cover 42 and the seating ring 40) are raised so that magnet 46 is adjacent to magnet sensor 50 providing a signal through flexible lead 52 to motor control circuit 82 within the flushing motor assembly 36 indicating that the cover 46 is in the open position.

Upon moving the cover 46 to the closed position, as indicated by arrow 84 in FIG. 1, the motor 68 in the flushing motor assembly 36 rotates the crank arm 72 to raise the pivot point 74 from its lowest point shown in FIG. 3(*a*) to its highest point shown in FIG. 3(*b*) thus raising the flapper valve 32 and allowing the flow of water into the bowl structure as indicated by arrows 86.

As shown in FIG. 3(*c*), the crank arm 72 continues to rotate in a counterclockwise direction 76 until the pivot point 74 is again in its lowermost position. However the natural buoyancy of the flapper valve 32 prevents the flapper valve from falling into the opening 24 until the water 16 has dropped to the bottom of the reservoir 12.

As noted above, the rotation of the crank arm 72 one revolution during the flushing cycle depicted in FIGS. 3(*a*) through 3(*c*) is controlled by means of the vane 78 and internal magnet sensor 80. Prior to a flushing, vane 78 interrupts magnet sensor 80 which removes power to the motor 68, by means of the motor control circuit 82 to stop the crank arm 72. Magnet sensor 80 is a normally-closed reed relay which is opened when an internally generated magnetic field is interrupted by vane 78. Movement of the cover 42 to the closed position activates the motor 68 for a brief period to move the crank arm 72 and vane 78 until the vane 78 no longer obstructs the internal magnet sensor 80. At this point, the magnet sensor 80 provides energy to the motor 68 and the crank arm 72 continues to move regardless of signals from the magnet sensor 50 or the position of the cover 42 until the crank arm 72 has completed one full revolution and the vane 78 once again interrupts magnet sensor 80.

Referring now to FIGS. 4 and 5, the control circuit 82 for controlling the motor 68 in response signals from the sensors 80 and 50 employs a transistor 88 placed in series with motor 68 across the batteries 64, to control the motor current. Internal magnet sensor 80 shunts transistor 88 so that motor 68, in fact, may be activated by current flowing through the transistor 88 or through the magnet sensor 80.

The controlling gate of transistor 88 is connected by series connected resistors 90 and 92 to ground. Before the flush is activated, the resistors 90 and 92 ensure that transistor 88 is not conducting current. Referring momentarily to FIG. 3(*a*), if transistor 88 is not conducting current, and the vane 78 is interrupting the magnet sensor 80, the motor 68 will be turned off. This condition occurs when the pivot point 74 of the crank arm 72 is in its lowermost position.

The junction 94 between resistors 90 and 92 is connected to one side of capacitor 96. The other side of capacitor 96 connects to a junction 98 between resistors 100 and 102. The other end of resistor 100 connects to ground and the other end of resistor 102 connects through magnet sensor 50 to the positive side of the batteries 64. Magnet sensor 50 is also a normally closed relay which is opened when magnet 46 approaches the magnet sensor 50 with the opening of the seat cover 42 so that the magnetic field at the sensor 50 exceeds the threshold field strength.

Referring to FIG. 4(*a*), the voltage at the junction 104 between resistor 102 and magnet sensor 50, if resistor 102 were disconnected from junction 98 would rise to approximately the voltage on the battery 64 when the seat cover 42 is closed, and the reed switch of magnet sensor 50 is closed, and drops to approximately zero volts when the seat cover 42 is opened, and the reed switch of magnet sensor 50 is opened. With the next closing of the seat cover 42, at flush initiating point 106, the voltage again rises to approximately that of the battery 64.

With the connection of resistor 102 to junction 98, the voltage at junction 98 generally follows that indicated above with respect to junction 104 when the seat cover 42 is closed, however, when the seat cover 42 is open, the voltage at junction 98 decays exponentially according to the RC time constant determined by capacitor 96 and resistor 100. In the preferred embodiment, this time constant is approximately ½ second. When the seat cover is closed at the flush initiation point 106, the voltage at junction 98 rises abruptly to approximately the voltage of the battery 64.

Referring now to FIG. 4(*c*), when the voltage at junction 98 rises at the flush initiation point 106, the voltage at junction 94 experiences a positive going pulse 113. This pulse 113, in turn, activates transistor 88 providing a current pulse 108 to motor 68 allowing motor 68 to move shaft 70 sufficiently so as to remove the vane 78 from the magnet sensor 80 and thus to begin the flush cycle as previously described.

Referring again to FIG. 4(*b*), if the seat cover 42 were to be opened at premature point 110, such as might be caused by a rapid movement of the seat cover 42 up and down to activate the flushing mechanism, the failure of capacitor 96 to have completely discharged results in the production of a voltage pulse 112 (shown in FIG. 4(*c*)) of much lower amplitude than the voltage pulse 113 produced at the flush initiation point 106. This pulse 112 will, in general, be of too low an amplitude and too little duration to activate the transistor 88 thus preventing flushing rapid movements of the seat cover 42 such as might be caused by accidental jarring of the seat cover 42 or intentional misuse. Thus, capacitor 96 provides an effective delay timer to prevent flushing for a predetermined period, dictated by the RC time constant of resistor 100 and capacitor 96, after the seat cover 42 is first opened.

Figure 6:
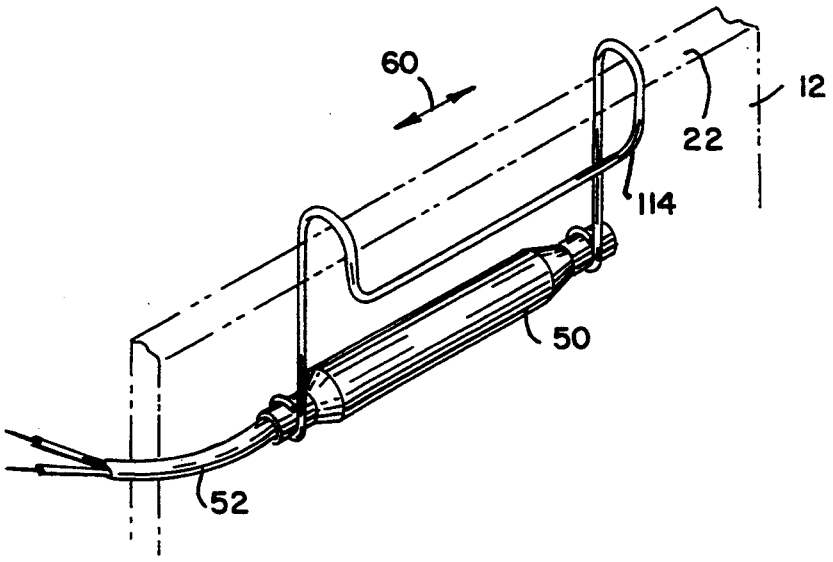
FIG. 6 is a perspective view of the magnet sensor of FIG. 1 showing the hanger for attaching the sensor unit to the tank wall.

Referring now to FIG. 6, the magnet sensor 50 is generally positioned within the reservoir 12 and is held on the rim 22 by a wire hanger 114 captured between the rim 22 and the reservoir cover 20 in much the same manner as the flange 58 associated with the flushing motor assembly 36. As held by the hanger 114, the magnet sensor 50 may slide in the lateral direction 60 to allow essentially independent positioning of the sensor 50 from that of the flushing motor assembly 36 and so as to permit the sensor to be movable along the wall of the reservoir 12 to within the magnet field boundary 48 for optimum sensitivity.

The above description has been that of a preferred embodiment of the present invention. It will occur to those who practice the art that many modifications may be made without departing from the spirit and scope of the invention. In order to apprise the public of the various embodiments that may fall within the scope of the invention, the following claims are made.

We claim:

1. A flushing mechanism for a toilet, the toilet being of the type having a water reservoir connected through a valve to a bowl to provide flushing water from the reservoir to the bowl for flushing waste from the bowl, the reservoir having a rim defining an opening at its top and having a lid for covering that opening, the bowl being of the type having a cover with an open position for providing access to the bowl and a closed position for at least partially covering such access, the flushing mechanism comprising:

a magnet positioned to move with the cover so as to lie adjacent to a sensing point when the cover is in a first position and to be removed from that sensing point when the cover is in a second position;

magnet sensing means positioned wholly within the reservoir and wholly under the tank lid for detecting the position of the magnet and for providing an electric sensing signal in response to the magnet moving between the first and second positions;

a first hanger sized to fit over and hang on the rim at a first selected position, the first hanger having a portion to be captured between the rim and the lid when the lid covers the opening, the first hanger being connected to the magnet sensing means for attaching the magnet sensing means to the rim near the sensing point;

a motor positioned within the reservoir that can respond to the sensing signal and rotate a motor shaft essentially 360° in a flush cycle in response thereto;

a crank arm attached to the motor shaft so as to rotate therewith, the arm having a pivot orbiting the motor shaft with rotation of that shaft;

a second hanger connected to the motor for attaching the motor to the rim, wherein the motor shaft is positioned relative to the pivot so as to be essentially vertically aligned with the valve, the second hanger being sized to fit over and hang on the rim at a second selected position, the second hanger having a portion to be captioned between the rim and the lid when the lid covers the opening, the second hanger being positionable independently of the position of the magnet sensing means;

a flexible electric cable positioned wholly under the lid connecting the magnet sensing means to the motor within the tank;

a tensile link extending downward from the pivot for connecting the pivot to the valve so that rotation of the crank arm opens the valve to allow flushing of the toilet;

whereby the motor and magnet sensing means may be independently positioned within the tank by sliding along the rim so as to operate with a plurality of tank configurations; and whereby when assembled on the toilet in operative fashion, the flushing mechanism will cause the toilet to be flushed when the cover is moved between the open position and a closed positions.

2. The flushing mechanism as recited in claim 1, wherein the first position is the open position and the second position is the closed position, and the sensing point is in the reservoir.

3. The flushing mechanism as recited in claim 1, wherein the tensile link is a chain attached to the pivot.

4. The flushing mechanism as recited in claim 1, wherein the magnet sensing means is a reed switch.

5. The flushing mechanism as recited in claim 1, wherein the motor shaft rotates no more than one revolution for each transition of the cover from open to closed position.

6. The flushing mechanism as recited in claim 1, further comprising a delay timer for preventing the rotation of the motor shaft for a predetermined time after the movement of the cover from the closed to the open position.

* * * * *

UNITED STATES PATENT AND TRADEMARK OFFICE

CERTIFICATE OF CORRECTION

PATENT NO. : 5,400,446

DATED : March 28, 1995

INVENTOR(S) : John M. Bloemer et al.

It is certified that error appears in the above-identified patent and that said Letters Patent is hereby corrected as shown below:

Col. 7, line 11 "portion to be captioned" should be --portion to be captured--.

Signed and Sealed this

First Day of August, 1995

Bruce Lehman

*Attest:*

BRUCE LEHMAN

*Attesting Officer*

*Commissioner of Patents and Trademarks*